United States Patent [19]

Bockelman et al.

[11] 4,101,271

[45] Jul. 18, 1978

[54] TANNING SKINS USING POLYCARBOXYLIC ACID PARTIAL ESTERS

[75] Inventors: Wolfgang Bockelman, Leverkusen; Hans Niederprüm, Monheim, both of Germany

[73] Assignee: Bayer Aktiengesellschaft, Leverkusen, Germany

[21] Appl. No.: 802,100

[22] Filed: May 31, 1977

[30] Foreign Application Priority Data

Jun. 12, 1976 [DE] Fed. Rep. of Germany ..... 2626429

[51] Int. Cl.[2] ..... C14C 3/02; C14C 3/06

[52] U.S. Cl. ..... 8/94.26; 8/94.27

[58] Field of Search ..... 8/94.26, 94.27

[56] References Cited

U.S. PATENT DOCUMENTS 4,042,321 8/1977 Backer ..... 8/94.26

FOREIGN PATENT DOCUMENTS 679,484 8/1939 Fed. Rep. of Germany.

*Primary Examiner*—A. Lionel Clingman

*Attorney, Agent, or Firm*—Burgess, Dinklage & Sprung

[57] ABSTRACT

In the chrome-tanning of skins with a chromium (III) salt and an acid-binding agent, the improvement which comprises effecting the chrome-tanning in the presence of a water-soluble partial ester of a polycarboxylic acid containing 4 to 11 carbon atoms which ester hydrolyzes into the free acid or its salt. The partial ester is advantageously present in about 0.5 to 2, preferably 1,3 to 1.8, times the molar amount of the chromium salt expressed as $Cr_2O_3$. The tanning composition can be formed by dissolving the desired ingredients and the solution spray dried to provide a properly formulated powder which can thereafter by employed to re-formulate the solution.

9 Claims, No Drawings

TANNING SKINS USING POLYCARBOXYLIC ACID PARTIAL ESTERS

This invention relates to a process for the chrome-tanning of animal skins in the presence of partially esterified dicarboxylic acids whereby it is possible to obtain complete tanning and to utilize the chrome liquors substantially completely.

In the manufacture of chrome-tanned leathers, only about 70 to 80% of the amount of chromium available is bound to the leather. The remaining 20 to 30% remain in the so-called residual liquor which can only be purified at considerable expense. In order to improve the utilization of chromium, it has already been proposed (cf. for example B. Schubert and H. Herfeld, Das Leder 26 (1975), 21) to reuse the liquor left at the end of tanning for tanning after the addition of fresh chromium salts and to repeat this process indefinitely. The disadvantage of this process is that, with increasing duration, leather fibers and undesirable salts accumulate in the liquors and, hence, prevent optimum tanning results from being obtained. Furthermore, this process is also very complicated to carry out.

German Offenlegungsschrift No. 2,424,300 describes a chrome-tanning process in which the chromium utilization of the residual liquors is considerably improved by carrying out tanning in the presence of aliphatic dicarboxylic acids and by maintaining specific conditions in regard to concentration and pH-value.

Efforts to improve and simplify this process have now culminated in the discovery of a process for the chrome-tanning of animal skins and/or for retanning leather with chromium(III) salts and acid-binding agents which is characterized by the fact that the chrome-tanning is carried out in the presence of water-soluble, partilally esterified polycarboxylic acids, especially dicarboxylic acids, containing 4 to 11 carbon atoms which can be hydrolyzed into the free acids or their salts.

It has surprisingly been found considerably advantageous to use the dicarboxylic acids not in the form of the pure acid or its alkali salts, but instead in a chemically modified form which is incapable of crosslinking the "chromium atoms", but which can be converted during tanning into the "active" dicarboxylic acid.

Whereas aliphatic monocarboxylic acids, for example, have a strong complexing (masking) effect on chromium(III) salts, they completely lack the crosslinking effect of dicarboxylic acids. However, the fact that a high level of utilization of the residual chrome liquors is obtained can be attributed to this effect. The partly or completely esterified dicarboxylic acids or dicarboxylic amides do not have any crosslinking effect upon chromium(III)salts in the pH-range used for tanning, namely from about pH 2.5 to about pH 4.5. However, the dicarboxylic acid esters cannot be used for tanning on account of their virtually complete insolubility in water and their almost complete resistance to hydrolysis in the above-mentioned pH-range which is important for tanning. However, it has been found that, by contrast, the only partially esterified dicarboxylic acids are both adequately soluble in water in the pH-range in question and hydrolyze sufficiently quickly under the tanning conditions (pH-range, concentration and temperature conditions) and, in doing so, slowly liberate the dicarboxylic acids required for crosslinking the chromium atoms so that, on completion of tanning, satisfactory utilization of the chromium present in the residual liquors is guaranteed.

Whereas the dicarboxylic acid semiesters and their alkali salts hydrolyze under the conditions applied during tanning and form the free carboxylic acids, it has surprisingly been found that solutions of tanning-active chromium(III)salts, together with dicarboxylic acid semiesters or their alkali salts, remain stable for prolonged periods (up to several weeks), and that there is no hydrolysis of the dicarboxylic acid semiester into the free dicarboxylic acid nor any crosslinking of the chromium(III)atoms accompanied by precipitation. On the contrary, the described solution is so stable, by virtue of the complex-forming effect of the dicarboxylic acid semiester (it acts in the same way as an aliphatic monocarboxylic acid), that this solution may be spray-dried. The powders obtained are readily soluble in water and, after dissolution, are fully active for tanning in the manner described. Nevertheless, the use of the liquid tanning mixture containing both chromium(III)-salts and also dicarboxylic acid semiesters affords advantages, particularly in the case of fully automatic dosage. On the other hand, it is also of advantage in some cases to use the spray-dried tanning composition because, in this case, the tanning agent can be used as a so-called "self-neutralizing tanning agent" following the addition of a low-acting neutralizing agent, for example, dolomite. The high level of utilization of the residual chrome liquors is unaffected by whether the tanning agent is used in liquid or solid form.

Chromium(III)salts suitable for tanning are the chromium (III) salts which are normally used for chrome-tanning, especially chromium(III)sulfates, basic chromium(III) sulfates, also chromium(III)salts masked with organic acids, for example formic acid, acetic acid, self-neutralizing chrome-tanning agents, chrome-tanning agents which, in addition to chromium(III)salts, also contain inorganic salts such as sodium sulfate, or reaction products of hexavalent chromium compounds with reducing agents.

The mixtures used for full tanning preferably contain chromium sulfates and basic chromium(III)salts. It is also possible to use masked chromium(III)salts, especially chromium(III)sulfates, which preferably only have a low degree of masking.

Suitable acid-binding agents are, for example, dolomite, alkali metal carbonates and bicarbonates, alkaline earth metal carbonates and bicarbonates, magnesium oxide or sodium sulfite.

The dolomite used is the mineral double salt $CaCO_3.MgCO_3$ which contains about 20 to 40% of CaO and preferably about 25 to 35% of CaO and about 10 to 25% of MgO and preferably about 16 to 24% of MgO. The dolomite may be used either individually or in combination with other acid-binding agents, the dolomite content of the mixtures preferably amounting to at least about 10% of the total quantity of acid-binding agents used.

Mixtures containing about 10 to 50 parts by weight of dolomite per 100 parts by weight of $Cr_2O_3$ are particularly suitable. The quantity of dolomite used is governed by the basicity of the chromium(III)salts used, by the basicity to which it is intended to take these chromium(III)compounds during tanning, by the basicity and quantity of the chromium(III) salts used for pretanning and by the quantity of the other acid-binding agents optionally present in the mixture.

The partly esterified polycarboxylic acids used in accordance with the present invention may be produced by methods known per se. The following possible methods for their production are mentioned by way of example:

a. reaction of dicarboxylic acids with dicarboxylic acid diesters (comproportionation or transesterification);
b. direct hydrolysis of dicarboxylic acid dialkyl esters;
c. reaction of dicarboxylic acid anhydrides with alcohols; and
d. alkoxylation of dicarboxylic acids.

Suitable dicarboxylic acids used as starting materials are aliphatic or aromatic, for example, succinic acid, glutaric acid, adipic acid, maleic acid, fumaric acid, aspartic acid, glutamic acid, phthalic acid and terephthalic acid.

Suitable alcohols are aliphatic mono- or polyhydroxy compounds which may contain ether groups in the chain. The chain length can vary considerably but generally there should be no more than about 5 carbon atoms per hydroxy group, for example, methanol, ethanol, iso- and n-propanol, iso- and n-butanol, iso- and n-amyl alcohol, glycol, glycerol, propylene glycol, butylene glycol, trimethylol propane and pentaerythritol.

Hides which have been delimed and pickled by methods known per se are used for carrying out the process according to the invention. Chrome-tanning is preferably carried out in the pickling bath; the bath quantity amounts to at most 100%, preferably to between 10 and 50% and, with particular preference, to between 20 and 30%, based on the weight of the hides.

The chromium(III)salts required for tanning are used in a quantity of about 1.0 to 2.5% of $Cr_2O_3$, preferably a quantity of about 1.5 to 1.8% of $Cr_2O_3$ and, with particular preference, in a quantity of about 1.5 to 1.6% of $Cr_2O_3$, based on the weight of the hides. The tanning mixtures according to the invention are added to the tanning liquor either in powder form or in the form of a solution or suspension. The components of the mixtures according to the invention are preferably added together. Of these components, only some may be added together, although each may be individually added. In cases where the chromium(III)salts are individually added, it is best to add them first.

The temperature prevailing during the tanning process ranges from about 25° C to 45° C, the temperature generally being lower at the beginning of tanning.

In one particular embodiment, the entire quantity of chromium(III)salt is left in contact with the skins on its own until the skins are tanned throughout their entire cross-section. The remaining components are then added in powder form either in admixture or in the form of a solution or suspension.

In one preferred embodiment, all the components of the mixtures are used in powder form or in the form of an aqueous solution or suspension.

The dicarboxylic acid semiesters are used for tanning in a quantity of about 0.5 mole to 2.0 moles per mole of $Cr_2O_3$, preferably in a quantity of about 1.3 to 1.8 moles per mole of $Cr_2O_3$ and, with particular preference, in a quantity of about 1.5 to 1.6 moles per mole of $Cr_2O_3$.

Tanning is carried out so that, on completion of tanning, the liquor has a pH-value of at least about 3.6 and more especially about 3.9 to 4.5.

The value of the process according to the invention lies above all in the fact that, in contrast to conventional tanning processes, a high degree of utilization is obtained and the tanning process is considerably simplified by virtue of the fact that the tanning mixtures may be used in liquid form or in the form of ready-formulated spray-dried and, hence, uniform substances. This affords inter alia the advantage of more convenient application (for example automatic dosage).

By adopting this procedure, it is possible to obtain particularly high levels of utilization of the tanning liquor without any adverse effect upon the quality of the leather utimately obtained in cases where the tanning process is carried out on a commercial scale. Residual liquors with a $Cr_2O_3$-content of less than about 1 g per liter are obtained.

The process according to the invention is illustrated by the following examples in which the parts and percentages quoted represent parts by weight and percent by weight, respectively.

a. Production of the semiesters used in accordance with the invention

1. Production of the semiester or its salts by transesterification (comproportionation)

123 g of a commercial grade glutaric acid mixture (1 mole, molar composition of the acid: approximately 50% of glutaric acid, 30% of succinic acid, 20% of adipic acid) were heated to a temperature of 180° C with 174 g of a commercial-grade glutaric acid dimethyl ester mixture (1.15 mole, so-called "AGS ester", quantitative ratios of the dicarboxylic acids same as in the commercial-grade glutaric acid mixture) and 11 ml of 2 N HCl, and kept at that temperature for 30 minutes. The product obtained after cooling was soluble in water and predominantly contained the semiesters of the above mentioned dicarboxylic acids in addition to small quantities of the free dicarboxylic acids.

Sodium salt of the semiester 137 g of semiester (1 mole) was diluted with the same volume of methanol (approximately 3 moles), followed by the addition of a solution of 40 g of NaOH(1 mole) in 180 ml of methanol. After heating to boiling point (reflux), followed by cooling to room temperature, the sodium salt precipitated was filtered under suction and dried.

Magnesium salt of the semiester 137 g of semiester (1 mole) were diluted with the same volume of methanol (approximately 3 moles), followed by the addition with vigorous stirring to the mixture of 40.3 g of magnesium oxide (1 mole). As soon as the magnesium oxide had reacted, the solution was concentrated by evaporation to dryness in rotary evaporator.

2. Production of the semiester salts from the dicarboxylic acid dialkyl esters by direct hydrolysis 151 g of AGS-ester with the composition indicated above were diluted with 100 ml of methanol (approximately 2.5 moles) and, after heating to 80° C (reflux), were reacted with a solution of 52 g of NaOH (1.3 moles) in 195 ml of methanol (approximately 5 moles). The methanolic NaOH-solution was added dropwise under reflux over a period of 45 minutes. The mixture was then kept at the reaction temperature for 1 hour and then left to cool to room temperature. The sodium salt of the AGS-semiester which was precipitated was filtered off under suction and dried. The filtrate was concentrated by evaporation and the residue was also dried.

The following other alkali metal salts of the dicarboxylic acid alkyl esters were produced by analogous methods:

glutaric acid methyl semiester, Na-salt
glutaric acid methyl semiester, K-salt
adipic acid methyl semiester, Na-salt
terephthalic acid ethyl glycol semiester, Na-salt 3. Production of the semiester or their salts by the acid anhydride process 100 g of succinic acid anhydride (1 mole) were heated under reflux with 80 ml of methanol (2 moles) for 2 hours by which time the anhydride had dissolved and reacted with the methanol to form the semiester. After the methanol had been distilled off, the succinic acid methyl semiester could be distilled off in an oil pump vacuum at 0.5 to 0.1 mm Hg. To produce the sodium salt, 132 g of the semiester (1 mole) were dissolved in 80 ml of methanol (2 moles) and, after heating (reflux), a mixture of 40 g of NaOH(1 mole) in 180 ml of methanol was added dropwise over a period of 1 hour. The mixture was then stirred under reflux for another 2 hours and subsequently cooled to room temperature. After the excess methanol had been evaporated off in a rotary evaporator, the residue was washed with ether and subsequently dried.

The following preparations were produced by analogous methods:

maleic acid methyl semiester, Na-salt
glutaric acid methyl semiester, Na-salt
glutaric acid methyl semiester, Mg-salt
glutaric acid ethyl semiester, Na-salt
glutaric acid isopropyl semiester, Na-salt
phthalic acid methyl semiester, Na-salt 4. Production of the semiesters or their salts by alkoxylation of the dicarboxylic acids 123 g of commercial-grade glutaric acid with the composition indicated above (1 mole) were heated beyond melting point (110° – 115° C), after which 58 g of propylene oxide (1 mole) were introduced into the melt with stirring over a period of 2 hours through a dropping funnel and inlet pipe. The melt was then stirred for another 2 hours at 115° C and subsequently cooled to room temperature.

To produce the sodium salt of the AGS propylene glycol semiester, 50 ml of methanol were added to the liquid semiester, the mixture was heated to reflux temperature and a solution of 40 g of NaOH (1 mole) in 180 ml of methanol was added dropwise over a period of 1 hour. The reaction mixture was then heated under reflux for another 2 hours and subsequently cooled to room temperature. After the excess methanol had been evaporated off in a rotary evaporator, the residue was washed with ether and subsequently dried.

The sodium salt of the AGS-ethylene glycol semiester (AGS-$\beta$-hydroxyethyl semiester) was produced by analogous methods using ethylene oxide instead of propylene oxide.

5. Production of the chrome-tanning agents according to the invention containing the dicarboxylic acid semiesters 300 g of a 33% basic chromium sulfate solution containing 15% of $Cr_2O_3$ (= 0.3 mole of $Cr_2O_3$) were diluted with 500 ml of water, followed by the addition with constant stirring at room temperature of 62 g (= 0.45 mole) of the AGS methyl semiester produced by the method described above. 25 g (= 0.23 mole) of calcium carbonate ($CaCO_3$-content 93.6%) were then stirred in over a period of 1 hour, followed by stirring for another 3 hours, after which the mixture was filtered off from the gypsum precipitated. After standing overnight, the solution was spray-dried. A grey-green powder which was almost completely soluble in water was obtained which had a $Cr_2O_3$-content of 24.7%.

A powder-form chrome-tanning agent was produced in the same way with the chemically pure glutaric acid methyl semiester (produced by the method described above from glutaric acid anhydride and methanol).

EXAMPLE 1

Two corresponding havles A and B of conventionally limed cowhides (split thickness 3.2 mm) were pickled and chrome-tanned for the purpose of comparison in a tanning vat.

100 parts by weight of one half A were washed for 10 minutes in the tanning vat with 300 parts by weight (based on the weight of the hides) of water at 38° C, after which the liquor was drained off. The hide was then delimed for 20 minutes with 50% of water at 35° C with 1.5% of ammonium chloride, 1.5% of ammonium sulfate and 0.3% of sodium bisulfite, and subsequently bated for 40 minutes with 0.7% of a standard bate (pH-value of the liquor 8.7). A cross-section of the hide did not turn phenolphthalein red in color. After rinsing with water at 20° C for 10 minutes, the rinsing water was drained off to leave a residual liquor of 30%. 5 minutes after the addition of 4.5% of sodium chloride, the hide was pickled for 60 minutes with 0.65% of formic acid (diluted 1:5) and 0.25% of sulfuric acid (diluted 1:10) (pH = 3.6).

3.0% of a powder-form 33% basic chromium(III) sulfate containing 26% of chromium oxide were introduced into the pickling liquor. After 1 hour, 5.8% of the tanning mixture described below were added, followed by drumming for another 8 hours. The tanning mixture consisted of 520 parts by weight of powder-form 33% basic chromium sulfate, containing 26% of chromium oxide, 115 parts of dolomite, 140 parts of glutaric acid and 225 parts of sodium glutarate. The final temperature was 45° C, the final pH-value was 4.0 and the residual liquor contained 0.5 g of $Cr_2O_3$/l, corresponding to a consumption level of 98.9%.

100 parts by weight of the corresponding half B of the hide, which had been pretreated and pickled in the same way as half A, had 9 parts by weight of a powder-form tanning mixture with the composition indicated below added to it in the pickling liquor, followed by drumming for another 8 hours. The tanning mixture consisted of 670 parts by weight of powder-form 33% basic chromium sulfate, containing 26% of chromium oxide, 73 parts by weight of dolomite and 257 parts by weight of the sodium salt of the methyl semiester of commercial-grade glutaric acid.

The final temperature was 45° C and the residual liquor contained 0.7 g of $Cr_2O_3$/l, corresponding to a consumption level of 98.5%. Even in the absence of chrome pretanning, a leather of entirely satisfactory quality was obtained by this procedure with high utilization of the chrome present in the residual liquor. By comparison with the corresponding half A, there was no discernible difference in the quality of the leather.

EXAMPLE 2

100 parts of cowhide (split thickness 3.2 mm) delimed and bated in the same way as described in Example 1 were pickled for 60 minutes in a tanning vessel with 20 parts of water at 25° C, 4.5% of sodium chloride and 0.6% of sulfuric acid (diluted 1:10) (pH 3.7). 9.38 parts of the tanning mixture described below were introduced into the pickling liquor. The tanning mixture consisted of 661 parts of powder-form 33% basic chromium(III)sulfate, containing 26% of chromium oxide, 73 parts of dolomite and 266 parts of the sodium salt of glutaric acid methyl semiester. The tanning time was 10 hours, the final temperature was 38° C and the chromium content of the residual tanning liquor amounted to 0.4 g of $Cr_2O_3$/l.

EXAMPLE 3

100 parts of cowhide pretreated in the same way as described in Example 2 were pickled in a tanning vessel with 4.5 parts of sodium chloride, 0.6 part of sulfuric acid (1:10) and 20 parts of water (pH 3.7). 6.2 parts of a powder-form 33% basic chromium(III)sulfate containing 26% of chromium oxide were introduced into the pickling liquor.

After 1 hour, 3 parts of the tanning mixture described below were added and tanning was continued for another 7 hours. The tanning mixture consisted of 223 parts of dolomite and 777 parts of the sodium salt of the methyl semiester of commercial-grade glutaric acid. The final tanning temperature was 38° C. The residual tanning liquor had a chromium content of 0.2 g of $Cr_2O_3$/l.

EXAMPLE 4

1000 parts of cowhide pretreated in the same way as described in Example 2 were pickled in a tanning vessel with 45 parts of sodium chloride, 6 parts of sulfuric acid (diluted 1:10) and 200 parts of water (pH 3.7). 72 parts of the tanning mixture described below were introduced into the pickling liquor and tanning continued for another 8 hours. The tanning mixture was prepared as follows: 278 parts of water and 125 parts of glutaric acid methyl semiester were added to 554 parts of 33% basic chromium (III)sulfate liquor containing 15.6% of $Cr_2O_3$, followed by the addition of 43 parts of calcium carbonate, and the gypsum precipitated was filtered off after 1 hour. The filtered solution was spray-dried and 91 parts of the spray-dried powder were mixed with 9 parts of dolomite. The final tanning temperature was 38° C and the residual tanning liquor contained 0.6 g of $Cr_2O_3$ per liter.

EXAMPLE 5

Conventionally limed cowhides (unsplit) were washed for 10 minutes in a tanning vessel with 200% of water at 38° C, based on the weight of the hides. The solution was drained off, after which the hides were delimed for 60 minutes with 30% of water at 35° C, 0.15% of formic acid (diluted 1:6), 4% of ammonium chloride and 0.8% of sodium bisulfite and were then bated for 40 minutes with 0.3% of a standard bate (pH-value of the liquor 8.4). A cross-section of the hides did not turn phenolphthalein red in color.

Corresponding pieces of hide, A and B, measuring about 8 × 30 cm, were pickled and chrome-tanned for the purposes of comparison in the drumming machine described by E. Komarek and G. Mauthe in "Das Leder", 12 (1961), pp. 285–289, more especially page 287.

100 parts of cowhide of piece A were pickled in the usual way in the drumming machine with 3 parts of sodium chloride, 0.7 parts of formic acid (diluted 1:6) and 0.5 part of sulfuric acid (diluted 1:10) in the presence of 11% of water (pH 3.7). 3 parts of powder-form 33% basic chromium(III)sulfate containing 26% of chromium oxide were introduced into the pickling liquor. After 1 hour, 5.8 parts of the tanning mixture described below were added. The tanning time was 8 hours, the final temperature was 40° C and the residual chromium content amounted to 0.6 g of $Cr_2O_3$/l.

The tanning mixture contained 520 parts of powder-form 33% basic chromium(III)sulfate containing 26% of chromium oxide, 140 parts of glutaric acid, 225 parts of sodium glutarate and 115 parts of dolomite.

100 parts of cowhide of the corresponding piece B were pickled in the drumming machine in the same way as piece A. 7 parts of the tanning mixture described in Example 4 were introduced into the pickling liquor, followed by drumming for another 9 hours. The final temperature was 40° C and the residual chromium content amounted to 0.9 g of $Cr_2O_3$/l.

Piece B tanned with the semiester-containing product tans through more quickly than piece A tanned with the product containing glutaric acid/sodium glutarate.

EXAMPLE 6

100 parts of cowhide (split thickness 3.2 mm) pretreated in the same way as described in Example 2 were pickled in the usual way in a tanning vessel with sodium chloride, sulfuric acid and formic acid in the presence of 20 parts of water (pH 3.6). 10 parts of the tanning mixture described below were introduced into the pickling liquor. The tanning mixture contained 625 parts of powder-form 33% basic chromium(III)sulfate, containing 26% of chromium oxide, 69 parts of dolomite and 306 parts of the sodium salt of the propylene glycol semiester of commercial grade glutaric acid. Tanning time: 8 hours, final temperature: 38° C. The residual liquor contained 0.2 g of $Cr_2O_3$/l.

EXAMPLE 7

100 parts of cowhide (split thickness 3.2. mm) pretreated in the same way as described in Example 2 were pickled in the usual way in a tanning vessel with sodium chloride, sulfuric acid and formic acid in the presence of 20 parts of water (pH 3.7). 9.6 parts of the tanning mixture described below were introduced into the pickling liquor. The tanning mixture consisted of 645 parts of powder-form 33% basic chromium(III)sulfate, containing 26% of chromium oxide, 71 parts of dolomite and 284 parts of the sodium salt of adipic acid methyl semiester. The tanning time was 9 hours and the final temperature was 38° C. The residual liquor contained 0.3 g of $Cr_2O_3$/l.

EXAMPLE 8

100 parts of cowhides pretreated in the same way as described in Example 2 were pickled in the usual way in a tanning vessel with sodium chloride, sulfuric acid and formic acid in the presence of 20 parts of water (pH 3.6). 9.8 parts of the tanning mixture described below were introduced into the pickling liquor. The tanning mixture consisted of 630 parts of powder-form 33% basic chromium(III) sulfate, containing 26% of chromium oxide, 70 parts of dolomite and 300 parts of the sodium salt of glutaric acid isopropyl semiester. The tanning time was 9 hours and the final temperature 38° C. The residual liquor contained 0.5 g of $Cr_2O_3$.

EXAMPLE 9

100 parts of cowhides pretreated in the same way as described in Example 2 were pickled in a tanning vessel with 20 parts of water, 4.5 parts of sodium chloride and 0.6 part of sulfuric acid (diluted 1:10) (pH 3.8). 3 parts of powder-form 33% basic chromium(III)sulphate containing 26% of chromium oxide were introduced into the pickling liquor. After 1 hour, 6 parts of the tanning mixture described below were added, followed by drumming for another 8 hours. The tanning mixture consisted of 516 parts of powder-form 33% basic chromium(III)sulfate, containing 26% of chromium oxide, 114 parts of dolomite and 370 parts of the magnesium salt of the methyl semiester of commercial-grade glutaric acid. The final temperature was 38° C and the residual liquor contained 1.2 g of $Cr_2O_3$/l (consumption level = 98.0%).

EXAMPLE 10

100 parts of cowhides pretreated in the same way as described in Example 2 were pickled in the usual way in a tanning vessel with sodium chloride, sulfuric acid and formic acid in the presence of 20 parts of water. 10.2 parts of the pickling mixture described below were added to the pickling liquor. The tanning mixture consisted of 610 parts of powder-form 33% basic chromium(III)sulfate, containing 26% of chromium oxide, 67 parts of dolomite and 323 parts of the potassium salt of terephthalic acid methyl semiester. The tanning time was 8 hours and the final temperature was 38° C. The residual liquor contained 0.2 g of $Cr_2O_3$ per liter.

EXAMPLE 11

100 parts of cowhides pretreated in the same way as described in Example 2 were pickled in the usual way in a tanning vessel with sodium chloride, sulfuric acid and formic acid in the presence of 10 parts of water (pH 3.6). 16.5 parts of a liquid tanning mixture containing 9.45% of chromium oxide and 13.6% of glutaric acid methyl semiester were added to the pickling liquor. After 2 hours, 3.8 parts of saturated sodium bicarbonate solution (containing 7.9% of $NaHCO_3$) were added. After another hour, another 3.8 parts of saturated sodium bicarbonate solution were added. Tanning was then continued for 5 hours. The final temperature was 38° C and the residual liquor contained 0.4 g of $Cr_2O_3$ per liter.

As noted, the process can be applied to chrome-tanning of skins, optionally pickled, which includes the retanning of leather.

It will be appreciated that the instant specification and examples are set forth by way of illustration and not limitation, and that various modifications and changes may be made without departing from the spirit and scope of the present invention.

What is claimed is:

1. In the chrome-tanning of skins with a chromium-(III) salt and an acid-binding agent, the improvement which comprises effecting the chrome-tanning in the presence of a water-soluble partial ester of a polycarboxylic acid containing 4 to 11 carbon atoms which ester hydrolyzes into the free acid or its salt.

2. A process as claimed in claim 1, wherein the partial ester is used in a quantity of from about 0.5 to 2 moles per mole of the chromium salt expressed as $Cr_2O_3$.

3. A process as claimed in claim 1, wherein the polycarboxylic acid partial ester is a mono-ester of an aromatic or aliphatic dicarboxylic acid with an aliphatic hydroxy compound having up to 5 carbon atoms per hydroxy group.

4. A process as claimed in claim 3, wherein the dicarboxylic acid is selected from the group consisting of succinic acid, glutaric acid, adipic acid, maleic acid, fumaric acid, aspartic acid, glutamic acid, phthalic acid and terephthalic acid, the hydroxy compound is selected from the group consisting of methanol, ethanol, iso- and n-propanol, iso- and n-butanol, iso- and n-amyl alcohol, glycol, glycerol, propylene glycol, butylene glycol, trimethylol propane and pentaerythritol, and the ester is used in a quantity of about 1.3 to 1.8 moles per mole of the chromium salt expressed as $Cr_2O_3$.

5. A tanning composition comprising a chromium-(III) salt, an acid-neutralizing agent and a water-soluble partial ester of a polycarboxylic acid containing 4 to 11 carbon atoms which ester hydrolyzes into the free acid or its salt when the composition is employed in tanning.

6. A composition as claimed in claim 5, wherein the partial ester is present in about 0.5 to 2 times the molar amount of the chromium salt expressed as $Cr_2O_3$.

7. A composition as claimed in claim 5, wherein the polycarboxylic acid partial ester is a mono-ester of an aromatic or aliphatic dicarboxylic acid with an aliphatic hydroxy compound having up to 5 carbon atoms per hydroxy group.

8. A process as claimed in claim 7, wherein the dicarboxylic acid is selected from the group consisting of succinic acid, glutaric acid, adipic acid, maleic acid, fumaric acid, aspartic acid, glutamic acid, phthalic acid and terephthalic acid, the hydroxy compound is selected from the group consisting of methanol, ethanol, iso- and n-propanol, iso- and n-butanol, iso- and n-amyl alcohol, glycol, glycerol, propylene glycol, butylene glycol, trimethylol propane and pentaerythritol, and the ester is present in a quantity of about 1.3 to 1.8 moles per mole of the chromium salt expressed as $Cr_2O_3$.

9. The process for producing a tanning composition as claimed in claim 5, comprising adding the chromium salt, acid-neutralizing agent and partial ester to water, and spray drying the solution to form a powder.

* * * * *